US009518380B2

(12) United States Patent
Campomanes

(10) Patent No.: US 9,518,380 B2
(45) Date of Patent: Dec. 13, 2016

(54) TOOL RETENTION SYSTEM

(71) Applicant: Caterpillar Inc., Peoria, IL (US)

(72) Inventor: Patrick Campomanes, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 162 days.

(21) Appl. No.: 14/155,766

(22) Filed: Jan. 15, 2014

(65) Prior Publication Data

US 2015/0197921 A1 Jul. 16, 2015

(51) Int. Cl.
*E02F 9/28* (2006.01)

(52) U.S. Cl.
CPC ..... *E02F 9/2841* (2013.01); *Y10T 29/49863* (2015.01)

(58) Field of Classification Search
CPC ..... E02F 9/2816; E02F 9/2833
See application file for complete search history.

(56) References Cited

U.S. PATENT DOCUMENTS 3,974,621 A * 8/1976 Stang ..... F16B 13/0816 29/525
4,067,657 A 1/1978 Kaarlela
4,433,496 A 2/1984 Jones et al.
5,410,826 A * 5/1995 Immel ..... E02F 9/2833 37/455
5,452,529 A 9/1995 Neuenfeldt et al.
5,718,070 A * 2/1998 Ruvang ..... E02F 9/2841 37/455
5,784,813 A 7/1998 Balassa et al.
5,868,518 A 2/1999 Chesterfield et al.
5,964,547 A 10/1999 Brinkley
6,009,644 A 1/2000 Hedley
6,108,950 A * 8/2000 Ruvang ..... E02F 9/2825 37/452
6,301,810 B1 10/2001 Fidler
(Continued)

FOREIGN PATENT DOCUMENTS

WO WO 2011/134014 11/2011

OTHER PUBLICATIONS

U.S. Appl. No. 13/862,114 of Marcus John Guethle et al. entitled "Steering Linkage Arrangement for Articulated Mobile Machine" filed Apr. 12, 2013.

(Continued)

*Primary Examiner* — Robert Pezzuto
*Assistant Examiner* — Jessica H Lutz
(74) *Attorney, Agent, or Firm* — Finnegan, Henderson, Farabow, Garrett & Dunner, LLP

(57) ABSTRACT

A retention system is provided for use with a ground engaging tool. The tool retention system may have a spool with an elongated channel, and a collar dividing the elongated channel into a first portion and a second portion. The tool retention system may also have a fastener disposed within the elongated channel and passing through the collar. The fastener may have a head located within the first portion and a threaded shank located within the second portion. The tool retention system may further have a resilient member disposed between the head of the fastener and the collar, and a slider threadingly engaged with the threaded shank and configured to slide within the second portion of the elongated channel as the fastener is rotated.

15 Claims, 4 Drawing Sheets

(56) References Cited

U.S. PATENT DOCUMENTS

| | | | | |
|---|---|---|---|---|
| 6,757,995 | B2 | 7/2004 | Pippins | |
| 6,986,216 | B2 | 1/2006 | Emrich et al. | |
| 7,121,023 | B2 | 10/2006 | Robinson et al. | |
| 7,516,564 | B2 | 4/2009 | Ruvang | |
| 7,640,684 | B2 | 1/2010 | Adamic et al. | |
| 8,302,333 | B2 * | 11/2012 | Ruvang | E02F 9/2825 37/455 |
| 8,458,931 | B2 | 6/2013 | Knight | |
| 2003/0070330 | A1 | 4/2003 | Olds et al. | |
| 2004/0107608 | A1 * | 6/2004 | Meyers | E02F 9/2825 37/452 |
| 2005/0028407 | A1 | 2/2005 | Ruvang et al. | |
| 2010/0170119 | A1 | 7/2010 | Almendros et al. | |
| 2011/0072693 | A1 | 3/2011 | Knight | |
| 2012/0260540 | A1 | 10/2012 | Guimaraes et al. | |
| 2013/0269222 | A1 | 10/2013 | Knight | |
| 2014/0082977 | A1 * | 3/2014 | Pilon | E02F 9/2833 37/453 |
| 2015/0096207 | A1 * | 4/2015 | Tasovski | E02F 9/2841 37/456 |

OTHER PUBLICATIONS

U.S. Appl. No. 13/914,297 of Garrett D. Knight entitled "Excavator Tooth Retention Device" filed Jun. 10, 2013.
http://xml.catmms.com/servlet/ImageServlet?imageId=C609127 &lmageType=2, pp. 1-24 (2010).
http://xml.catmms.com/servlet/ImageServlet?imageId=C743073 &imageType=2, pp. 1-20 (2012).
U.S. Appl. No. 13/920,539, filed Jun. 18, 2013.
U.S. Appl. No. 13/948,836, filed Jul. 23, 2013.

* cited by examiner

TOOL RETENTION SYSTEM

TECHNICAL FIELD

The present disclosure relates generally to a retention system and, more particularly, to a system for retaining a ground engaging tool connected to a work implement.

BACKGROUND

Earth-working machines, such as cable shovels, excavators, wheel loaders, and front shovels, include implements generally used for digging into, ripping, or otherwise moving earthen material. These implements are subjected to extreme abrasion and impacts that cause them to wear. To prolong the useful life of the implements, various ground engaging tools can be connected to the earth-working implements at areas experiencing the most wear. These ground engaging tools are replaceably connected to the implements using a retention system.

An exemplary retention system is disclosed in U.S. Patent Publication 2011/0072693 of Knight that published on Mar. 31, 2011 ("the '693 publication"). Specifically, the '693 publication discloses a fork-shaped tool body that fits over the front edge of an excavator bucket. A clamp passes through the body and the bucket, and a wedge is inserted alongside the clamp to hold the clamp in position. The wedge has a U-shaped axial recess, and a threaded rod is received within the recess and oriented at an angle relative to the clamp. A threaded block is mounted to the rod, and the rod is rotatable to move the block along the rod. The block includes teeth that engage the clamp upon insertion of the wedge into the body, such that as the rod is rotated and the block moves along the rod, the wedge is forced further into the body. As the wedge is forced further into the body, the clamp is urged tighter against the body and the bucket. With this configuration, the fork-shaped tool body can be removably connected to the excavator bucket by rotation of the rod.

Although acceptable for some applications, the retention system of the '693 publication may be less than optimal. In particular, the toothed engagement between the block and the clamp may be a costly feature that has geometry that is difficult to control during manufacturing. In addition, after a period of wear, the clamp may become loose, requiring further adjustment of the rod. In some situations, the amount of adjustment required to tighten the joint may require replacement of the clamp with a different size of clamp, which can be expensive for an owner of the machine. Further, as the retention system wears and is adjusted, it may be possible for the wedge to be moved too far into the tool body, making replacement difficult.

The disclosed tool retention system is directed to overcoming one or more of the problems set forth above.

SUMMARY

According to one exemplary aspect, the present disclosure is directed to a tool retention system. The tool retention system may include a spool having an elongated channel, and a collar dividing the elongated channel into a first portion and a second portion. The tool retention system may also include a fastener disposed within the elongated channel and passing through the collar. The fastener may have a head located within the first portion and a threaded shank located within the second portion. The tool retention system may further include a resilient member disposed between the head of the fastener and the collar, and a slider threadingly engaged with the threaded shank and configured to slide within the second portion of the elongated channel as the fastener is rotated.

According to another exemplary aspect, the present disclosure is directed to another tool retention system. This tool retention system may include a spool having an elongated channel, a collar dividing the elongated channel into a first portion and a second portion, and a pocket formed within the second portion at an end opposite the collar. The tool retention system may also include a fastener disposed within the elongated channel and passing through the collar. The fastener may have a head located within the first portion and a threaded shank located within the second portion. The tool retention system may also include a slider threadingly engaged with the shank and configured to slide within the second portion of the elongated channel as the fastener is rotated, and a wedge configured to selectively interlock with the slider only when the slider is out of the pocket.

According to yet another exemplary aspect, the present disclosure is directed to a method of connecting a removable tool to work implement. The method may include rotating a fastener in a first direction to move a slider connected with the fastener and compress a resilient member, and inserting the fastener, slider, and compressed resilient member into an elongated channel of a spool. The method may also include rotating the fastener in a second direction to move the slider and allow the resilient member to decompress. The decompression of the resilient member may lock the fastener, slider, and resilient member to the spool.

DETAILED DESCRIPTION

Figure 1:
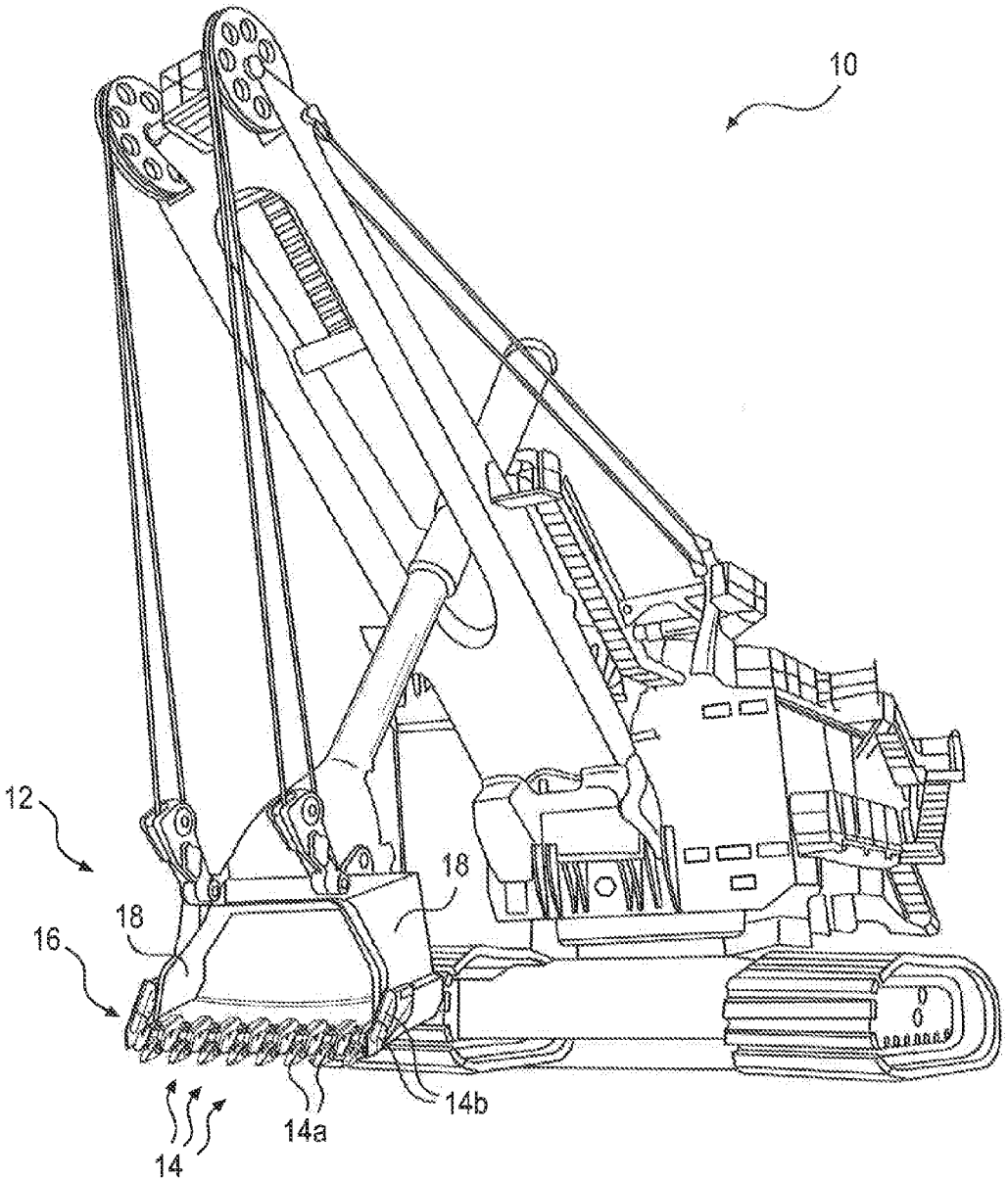
FIG. 1 is an isometric illustration of an exemplary disclosed machine.

FIG. 1 illustrates a mobile machine 10 having a work implement 12 operatively connected at a leading end. In the disclosed embodiment, machine 10 is a cable shovel. It is contemplated, however, that machine 10 may embody any other type of mobile or stationary machine known in the art, for example an excavator, a motor grader, a dragline, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform the task assigned to machine 10. For example, work implement 12 may be a shovel (shown in FIG. 1), a blade, a bucket, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located around an opening thereof. For example, the disclosed shovel is shown as being provided with multiple tooth assemblies 14*a* that are spaced apart along the length of a cutting edge 16, and multiple wing shrouds 14*b* that are located at vertical sidewalls 18 of the shovel. It is contemplated that GET 14 could take any other form known in the art, for example a fork configuration, a chisel configuration, a hook configuration, or a blunt-end configuration. Other configurations may also be possible.

Figure 2:
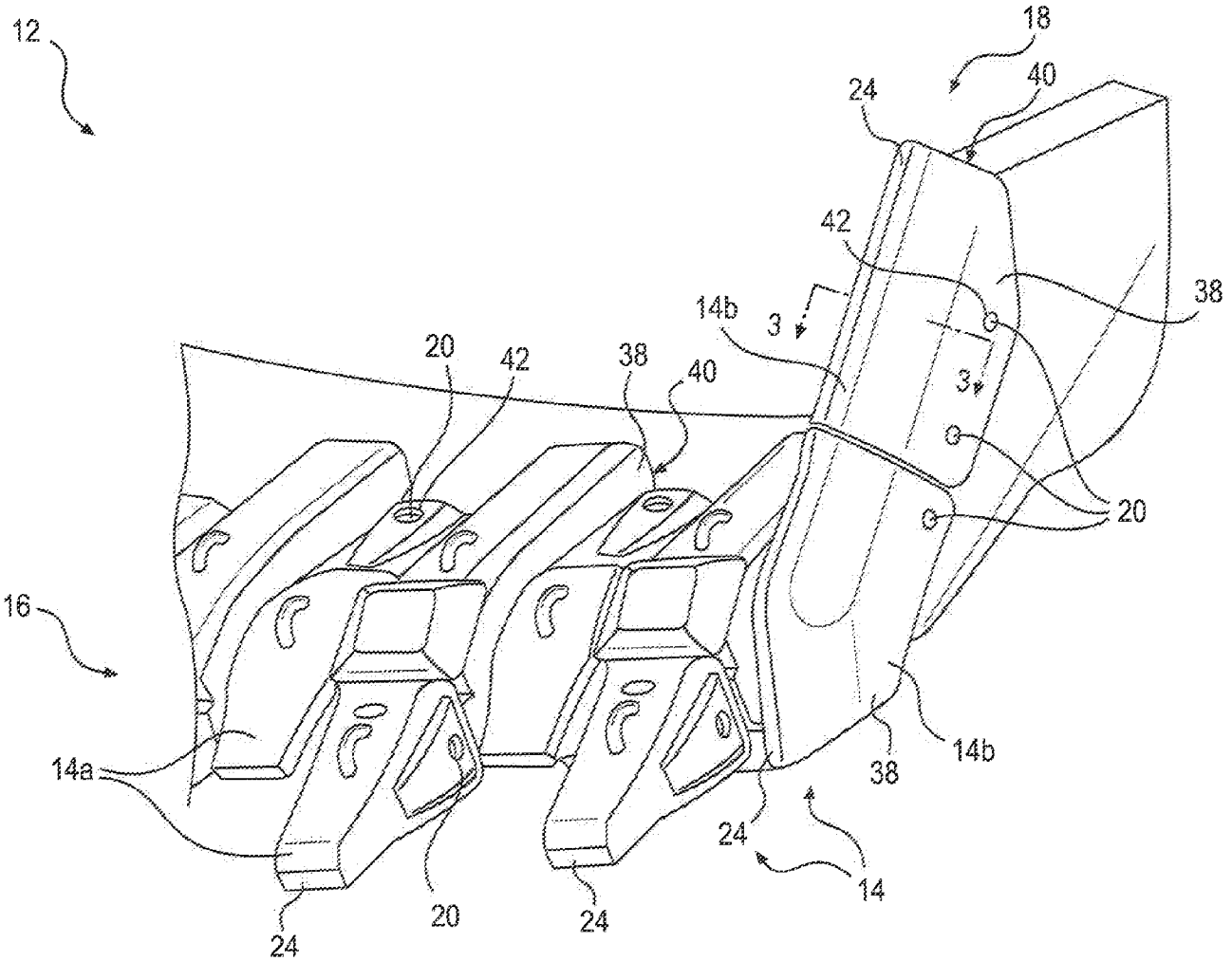
FIG. 2 is an isometric illustration of an exemplary disclosed tool retention system that may be used in conjunction with the machine of FIG. 1.
Figure 3:
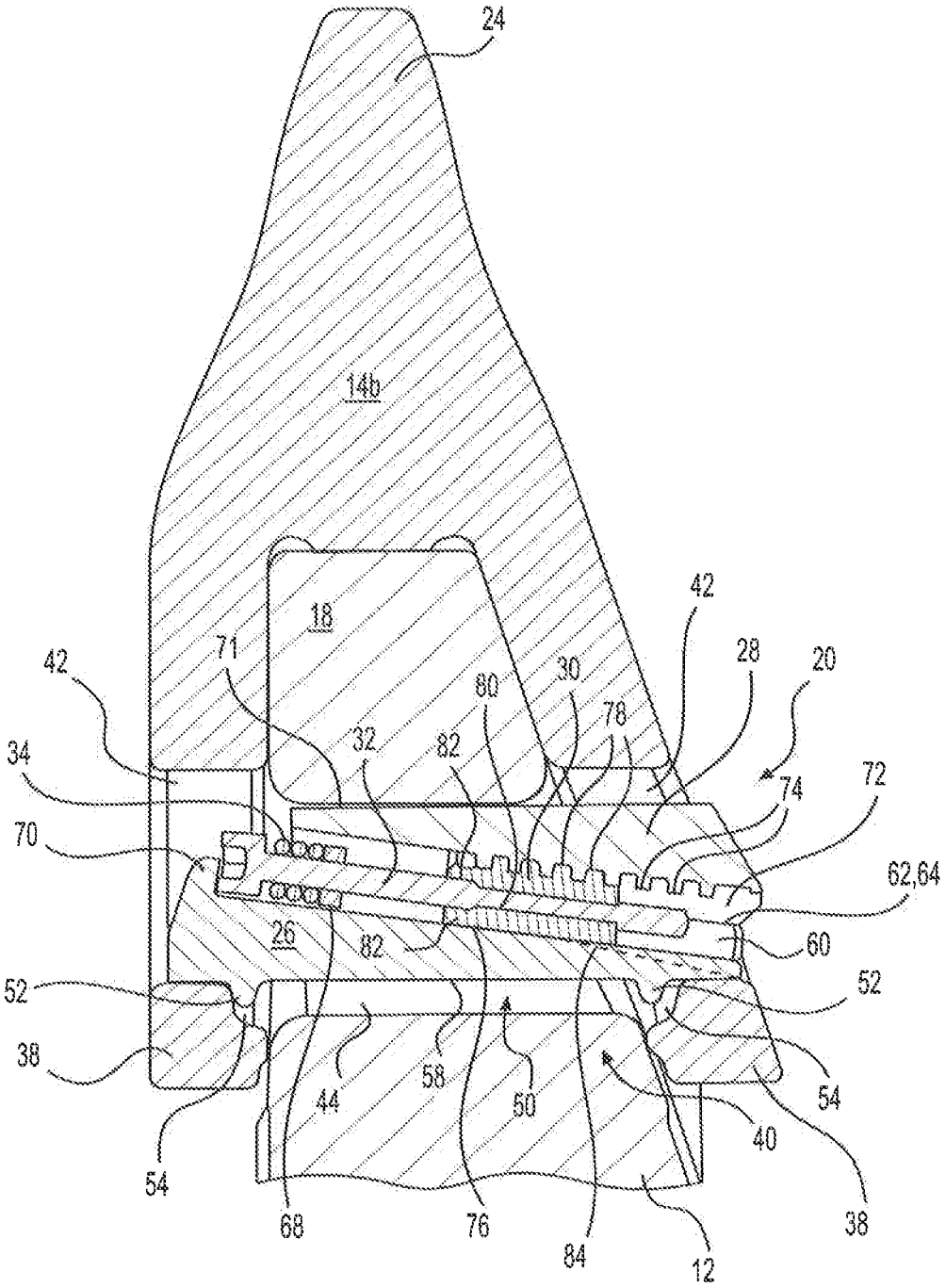
FIG. 3 is a cross-sectional illustration of an exemplary portion of the tool retention system of FIG. 2.

As shown in FIGS. 2 and 3, each GET 14 may include legs 38 that extend in a direction away from an external end 24. Legs 38 may be spaced apart from each other to form an opening 40 therebetween that is large enough to receive cutting edge 16 and/or vertical sidewall 18 of work implement 12. An aperture 42 may be formed within each leg 38, and apertures 42 may be generally aligned with each other and with a corresponding aperture 44 (shown only in FIG. 3) in work implement 12. In the disclosed embodiments, apertures 42, 44 may be generally cylindrical or elliptical, although other contours may also be utilized.

Each GET 14 may be removably connected to work implement 12 by way of a retention system 20. In this manner, each GET 14 may function as a wear piece at the attachment location, and be periodically replaced when worn or misshapen beyond a desired or effective amount. Retention system 20 may be configured to pass through and engage the curved surfaces of apertures 42 and 44, thereby locking GET 14 to work implement 12. It is contemplated that the same retention system 20 may be used for all GET 14 or that a different retention system 20 may be used for different types of GET 14, as desired.

Figure 4:
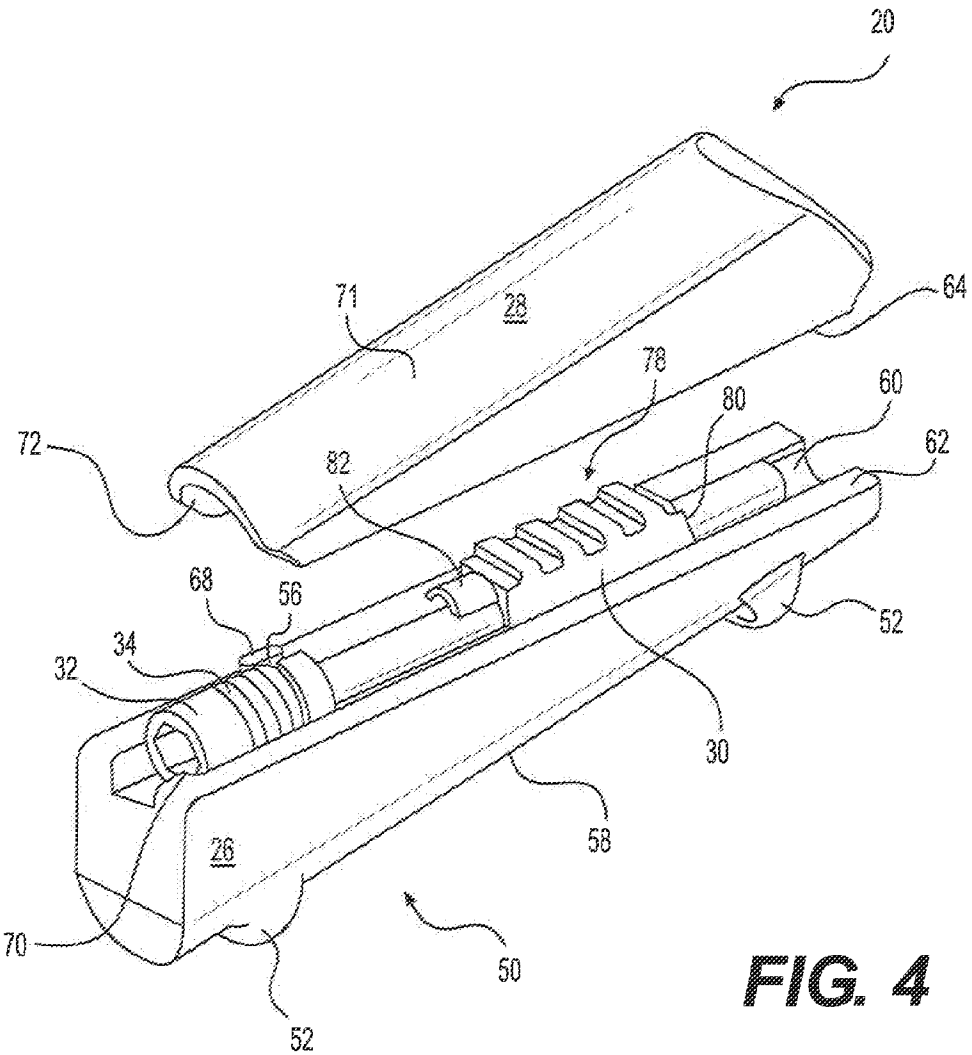
FIG. 4 is an isometric illustration of the portion of the tool retention system of FIG. 3.

The exemplary retention system 20 shown in FIGS. 3 and 4 includes multiple components that interact to clamp an associated GET 14 (e.g., each wing shroud 14*b*) in a removable manner to cutting edge 16 and/or vertical sidewall 18 of work implement 12. Specifically, retention system 20 includes a spool 26, a wedge 28, a slider 30, a fastener 32, and a resilient member 34. As will be described in more detail below, spool 26 may pass through GET 14 (e.g., through apertures 42 of wing shroud 14*b*) and work implement 12 (e.g., through aperture 44), and wedge 28 may be used to hold spool 26 in place. Slider 30 may selectively engage wedge 28 and be connected to spool 26 by fastener 32. Resilient member 34 may be a Belleville washer, spring, rubber bushing, or other device that rides on fastener 32 within spool 26 to maintain a desired connection force of retention system 20.

As shown in FIGS. 3 and 4, spool 26 may have a middle section 50 and spaced-apart arms 52 located at opposing ends of middle section 50. Spool 26 may be inserted through apertures 42 of GET 14 and aperture 44 of work implement 12, with arms 52 oriented away from vertical sidewall 18 (or cutting edge 16, as with tooth assemblies 14*a*) and toward legs 38 of GET 14. Inner surfaces of arms 52 may be configured to engage work implement 12 and outer surfaces of arms 52 may be configured to engage legs 38 of GET 14, such that as spool 26 is forced away from cutting edge 16 be wedge 28, arms 52 may generate inward forces (i.e., toward work implement 12) that push GET 14 further onto work implement 12. In some instances, pockets 54 may be formed within the inner surfaces of legs 38 to receive arms 52 of spool 26.

Middle section 50 of spool 26 may have an inner surface 58 between arms 52 that is generally curved to match the cylindrical profile of apertures 42, 44 when assembled, and a generally flat outer surface 62 opposite arms 52 that is inclined relative to an axis of apertures 42, 44. As spool 26 is moved away from vertical sidewall 18 (or cutting edge 16) toward legs 38, inner surface 58 of middle section 50 may engage the curved inner end surfaces of apertures 42 and/or 44.

An elongated channel 60 may be formed within outer surface 62 of spool 26, and a collar 68 may be located to divide channel 60 lengthwise into a first portion and a second portion. The first portion of channel 60 may be configured to receive a head of fastener 32 and resilient member 34, while the second portion may be configured to receive a threaded shank of fastener 32 and slider 30. An end stop 70 may be formed within the first portion of channel 60, at an end opposite collar 68. Collar 68 may be configured to provide a reaction and axial support point for resilient member 34, while end stop 70 may be configured to provide a reaction and axial support point for the head of fastener 32. With this configuration, a bias generated by resilient member 34 after insertion of fastener 32 and resilient member 34 into the first portion of channel 60, may function to push the head of fastener 32 axially away from collar 68 and against end stop 70. This action may help to retain fastener 32 and resilient member within the first portion of channel 60 during assembly of retention system 20. In some embodiments, collar 68 may be notched (shown in FIG. 4) to facilitate assembly or disassembly of fastener 32 from spool 26.

In the disclosed embodiment, channel 60 and collar 68 may both be generally circular in cross-section, and have an open side oriented away from spool 26. It is contemplated, however, that channel 60 and/or collar 68 may have another shape, if desired, such as a square or rectangular cross-section. In some embodiments, a cylindrical depression 56 may be formed within an axial end of collar 68 (i.e., the end facing the first portion of channel 60) and/or within end stop 70, and configured to seat resilient member 34 and/or the head of fastener 32 to thereby inhibit unintentional removal thereof.

Wedge 28 may be located immediately adjacent outer surface 62 of spool 26 (e.g., at a side of spool 26 opposite arms 52 and closer to vertical sidewall 18), and have a generally flat inclined inner surface 64 configured to slide against outer surface 62. Wedge 28 may also have an outer surface 71 that is curved to match the cylindrical profile of apertures 42, 44. With this arrangement, as wedge 28 is pulled further through apertures 42, 44 and into opening 40, spool 26 may be forced more toward the distal ends of legs 38 (i.e., against opposing end surfaces of apertures 42, 44).

Like spool 26, wedge 28 may also be provided with a longitudinal channel 72 formed within inclined surfaces 64. Channel 72 may be divided into a first portion and a second portion. The first portion of channel 72 may generally align with the first portion of channel 60 in spool 26, while the second portion of channel 72 may generally align with the second portion of channel 60. The first portion of channel 72 may simply provide clearance for the head of fastener 32, resilient member 34, and collar 68, while the second portion of channel 72 may be provided with teeth 74 (shown only in FIG. 3). As will be described in more detail below, teeth 74 may be configured to mesh with corresponding teeth of slider 30, and be used to pull wedge 28 into engagement with apertures 42, 44.

Slider 30 may be generally cylindrical, having a smooth outer surface 76 (shown only in FIG. 3) configured to slide within channel 60 of spool 26, and an opposing toothed surface 78 configured to mesh with teeth 74 of wedge 28. Slider 30 may also include a threaded bore 80 configured to receive the threaded shank of fastener 32. With this configuration, as fastener 32 is rotated within collar 68, slider 30 may be caused to slide along the length of channel 60.

In the disclosed embodiment, slider 30 may be provided with one or more protrusions 82 that are configured to facilitate subassembly of slider 30, fastener 32, and resilient member 34 into spool 26. Protrusions 82 may be shaped to extend axially from an end of slider 30 toward the head of fastener 32 and to pass through the notched area of collar 68 (e.g., at opposing sides of fastener 32). As will be described in more detail below, protrusions 82 may be used to selectively compress resilient member 34 during assembly and disassembly.

Fastener 32 may be configured to adjustably join slider 30 with wedge 28. In particular, as the head of fastener 32 is rotated by a service technician, the threaded shank of fastener 32 may interact with bore 80 of slider 30 to cause linear translation of slider 30 within channel 60. Slider 30, having toothed surface 78 intermeshed with teeth 74 of wedge 28, may then transfer its linear motion to wedge 28. In other words, as fastener 32 is rotated within spool 26, wedge 28 may be forced into or out of apertures 42, 44 by slider 30, depending on the direction of fastener rotation. And as described above, the linear motion of wedge 28 may correspond with the clamping forces generated by spool 26 on GET 14 and work implement 12.

In addition to facilitating subassembly of spool 26 (as will be described in more detail below), resilient member 34 may also be used to maintain a desired amount of tension with fastener 32 after assembly. In particular, after insertion of retention system 20 through apertures 42, 44 of work implement 12 and GET 14, fastener 32 may be tightened to a desired level of tension that properly secures GET 14 to work implement 12. However, over time, this connection may loosen due to wear and/or deformation of the different components. Conventionally, in order to maintain GET 14 properly secured to work implement 12, fastener 32 would have to be retightened, which can be a time consuming and difficult task. However, with the disclosed configuration, resilient member 34 may instead decompress somewhat as the different components wear, thereby taking up slack created within the assembly. In this manner, manual service of retention system 20 may not be required as often, and the connection of GET 14 to work implement 12 may be maintained at a desired level for a greater period of time. An additional purpose of resilient member 34 may be to provide substantially constant tension on the threads of fastener 32, thus providing resistance to loosening of fastener 32 due to cyclical loading and vibrations.

In an alternative embodiment shown by dashed lines in FIG. 3, spool 26 may be provided with a pocket 84 located at an end of channel 60 opposite collar 68. Pocket 84 may be an inclined area of increased depth, wherein pocket 84 becomes deeper at distances further away from collar 68. In this embodiment, when slider 30 is moved away from collar 68 toward the distal end of channel 60, toothed surface 78 of slider 30 may drop out of meshed engagement with teeth 74 of wedge 28. This may be helpful during assembly of wedge 28, allowing wedge 28 to be inserted a greater distance through apertures 42, 44 before engagement of toothed surface 78 with teeth 74. By inserting wedge 28 further into opening 40 before teeth 74 become locked with toothed surface 78, a greater number of teeth may engage each other for greater strength in the engagement. In addition, the technician may not be required to rotate fastener 32 as much to achieve the desired level of engagement.

INDUSTRIAL APPLICABILITY

The disclosed tool retention system may be applicable to various earth-working machines, such as cable shovels, wheel loaders, excavators, front shovels, draglines, and bulldozers. Specifically, the tool retention system may be used to removably connect ground engaging tools to the work implements of these machines. In this manner, the disclosed retention system may help to protect the work implements against wear in areas experiencing damaging abrasions and impacts. In addition, because of the self-adjusting nature of the disclosed retention system (i.e., because of the use of resilient member 34 to maintain the connection force of GET 14 and work implement 12), service requirement of the retention system may be low. Use of tool retention system 20 to connect GET 14 to work implement 12 will now be described in detail.

To connect a particular GET 14 to work implement 12, for example to connect wing shroud 14*b* to vertical sidewall 18, a service technician may first position legs 38 of wing shroud 14*b* over opposing surfaces of vertical sidewall 18 so that apertures 42 are generally aligned with aperture 44 of work implement 12. A subassembly, consisting of spool 26, slider 30, fastener 32, and resilient member 34, may then be inserted through apertures 42 and 44, with arms 52 of spool 26 facing toward the distal ends of legs 38 (e.g., within pockets 54). Inner surfaces of arms 52 may engage the opposing surfaces of work implement 12 at apertures 42, while outer surfaces of arms 52 may engage legs 38 of GET 14. Slider 30, at this point in time, may be located at or near the end of channel 60 opposite collar 68 (e.g., within pocket 84, if channel 60 is formed to have pocket 84).

Once the above-described subassembly is in place within opening 40, the service technician may insert wedge 28 through apertures 42, 44. At this point in time, inclined surface 64 of wedge 28 should rest against outer surface 62 of spool 26. The service technician may push wedge 28 as far as possible into opening 40, and then begin to rotate fastener 32 to tighten the connection between work implement 12 and GET 14. Specifically, as the service technician drives fastener 32 into slider 30 (e.g., by a clockwise rotation of the head of fastener 32), toothed surface 78 of slider 30 may interlock with teeth 74 of wedge 28 (e.g., be drawn out of pocket 84 and into engagement with wedge 28) and advance wedge 28 further into opening 40. Because of the tapered shape of wedge 28, advancement of wedge 28 into opening 40 may force spool 26 away from wedge 28. And as spool 26 moves toward the distal ends of legs 38, a greater clamping force may be exerted on legs 38. This force may function to hold GET 14 in place during operation of machine 10, and arms 52 may inhibit unintentional removal of retention system 20. Once the appropriate clamping force has been generated between work implement 12 and GET 14 by tightening of fastener 32, resilient member may maintain this level of force as component of GET 14 and retention system 20 wear over time.

The subassembly of spool 26, slider 30, fastener 32, and resilient member 34 may facilitate simple and quick connection of GET 14 with work implement 12 in the field. This subassembly may be created by first placing resilient member 34 over the shank portion of fastener 32 and up against the head. Slider 30 may then be threaded onto the shank portion, and drawn toward the head of fastener 32 (e.g., by way of clockwise rotation of fastener 32) until resilient member 34 is sufficiently compressed. At this point in time, slider 30, fastener 32, and resilient member 34 may be placed inside channel 60 of spool 26. Specifically, the head of fastener 32 together with resilient member 34 may be placed within the first portion of channel 60, at one side of collar 68, and slider 30 may be placed within the second portion of channel 60 at the opposing side of collar 68 (i.e., with protrusions 82 being located within the notched area of collar 68). Because resilient member 34 may be compressed during this operation, there should be sufficient axial clearance within the first portion of channel 60 to allow this placement without great difficulty. After placement of slider 30, fastener 32, and resilient member 34 into channel 60 of spool 26, fastener 32 may be rotated in an opposing direction (e.g., counterclockwise direction) to move slider 30 away from collar 58 (i.e., to move protrusions 82 away from resilient member 34 and out of the notched area of collar 68) and allow decompression of resilient member 34. As resilient member 34 decompresses during this movement, an end of resilient member 34 may eventually seat within depression 56 of collar 68 and the head of fastener 32 may be forced against end stop 70. This may complete the subassembly and inhibit unintentional disassembly of the components.

To disassemble retention system 20, fastener 32 may be rotated in a counterclockwise direction. This may function to move the head of fastener 32 away from collar 68 until end stop 70 is engaged. At this point, further counterclockwise rotation of fastener 32 may cause slider 30 and wedge 28 to move axially in an opposing direction until wedge 28 is pushed out of apertures 42, 44 and/or until slider 30 enters pocket 84 and disengages wedge 28.

The disclosed retention system may be relatively simple and low-cost. Specifically, because spool 26 and wedge 28 may engage each other at a smooth sliding surface, these components may be easy to manufacture, resulting in inexpensive parts. In addition, because excessive wear can be automatically accommodated with decompression of resilient member 34, service costs of machine 10 may be kept low.

It will be apparent to those skilled in the art that various modifications and variations can be made to the disclosed retention system. Other embodiments will be apparent to those skilled in the art from consideration of the specification and practice of the disclosed retention system. It is intended that the specification and examples be considered as exemplary only, with a true scope being indicated by the following claims and their equivalents.

What is claimed is:

1. A tool retention system, comprising:

a spool having an elongated channel, and a collar dividing the elongated channel into a first portion and a second portion;

a fastener disposed within the elongated channel and passing through the collar, the fastener having a head located within the first portion and a threaded shank located within the second portion;

a resilient member disposed between the head of the fastener and the collar; and a slider threadingly engaged with the threaded shank and configured to slide within the second portion of the elongated channel as the fastener is rotated, wherein the slider includes at least one protrusion that extends axially toward the collar, and the collar is notched to allow passage of the at least one protrusion.

2. The tool retention system of claim 1, further including a wedge configured to interlock with the slider.

3. The tool retention system of claim 1, wherein the collar includes a depression configured to seat the resilient member.

4. The tool retention system of claim 1, wherein:

the spool includes an end stop located a distance away from the collar; and the resilient member is configured to bias the head of the fastener away from the collar and against the end stop.

5. The tool retention system of claim 2, wherein outer surfaces of the spool and wedge are curved.

6. The tool retention system of claim 1, wherein the spool includes spaced apart arms that extend in a direction away from the wedge.

7. The tool retention system of claim 1, wherein the spool further includes a pocket located at an end of the elongated channel opposite the collar, the pocket configured to allow selective disengagement of the slider from the wedge.

8. The tool retention system of claim 7, wherein the pocket increases in depth at greater distances away from the collar.

9. A tool retention system, comprising:

a spool having an elongated channel, a collar dividing the elongated channel into a first portion and a second portion, and a pocket formed within the second portion at an end opposite the collar;

a fastener disposed within the elongated channel and passing through the collar, the fastener having a head located within the first portion and a threaded shank located within the second portion;

a slider threadingly engaged with the threaded shank and configured to slide within the second portion of the elongated channel as the fastener is rotated; and a wedge configured to selectively interlock with the slider only when the slider is out of the pocket, wherein the slider includes at least one protrusion that extends axially toward the collar, and wherein the collar is notched to allow passage of the at least one protrusion.

10. The tool retention system of claim 9, wherein the collar includes an annular depression.

11. The tool retention system of claim 10, wherein:

the spool includes an end stop located a distance away from the collar; and the head of the fastener is located between the collar and against the end stop.

12. The tool retention system of claim 9, wherein outer surfaces of the spool and wedge are curved.

13. The tool retention system of claim 9, wherein the spool includes spaced apart arms that extend in a direction away from the wedge.

14. The tool retention system of claim 9, wherein the pocket increases in depth at greater distances away from the collar.

15. A tool retention system, comprising:

a spool having an elongated channel, and a collar dividing the elongated channel into a first portion and a second portion;

a fastener disposed within the elongated channel and passing through the collar, the fastener having a head located within the first portion and a threaded shank located within the second portion;

a Belleville washer or a spring disposed between the head of the fastener and the collar; and a slider threadingly engaged with the threaded shank and configured to slide within the second portion of the elongated channel as the fastener is rotated, wherein the slider includes at least one protrusion that extends axially toward the collar, and the collar is notched to allow passage of the at least one protrusion.

* * * * *